United States Patent [19]

Coffindaffer

[11] Patent Number: 4,863,620

[45] Date of Patent: Sep. 5, 1989

[54] ACIDIC LIQUID FABRIC SOFTENER WITH YELLOW COLOR THAT CHANGES TO BLUE UPON DILUTION

[75] Inventor: Timothy W. Coffindaffer, Loveland, Ohio

[73] Assignee: The Procter & Gamble Company, Cincinnati, Ohio

[21] Appl. No.: 259,075

[22] Filed: Oct. 18, 1988

[51] Int. Cl.[4] ..... D06P 5/06

[52] U.S. Cl. ..... 252/8.8; 8/137; 8/506; 252/8.6

[58] Field of Search ..... 252/88; 8/137

[56] References Cited

U.S. PATENT DOCUMENTS

| | | | |
|---|---|---|---|
| 4,203,851 | 5/1980 | Ramachawdran | 252/8.6 |
| 4,255,294 | 3/1981 | Rudy et al. | 252/8.6 |
| 4,272,413 | 6/1981 | Bauman | 252/8.8 |
| 4,283,192 | 8/1981 | Bauman | 8/137 |
| 4,562,097 | 12/1985 | Walter et al. | 8/477 |
| 4,661,267 | 4/1987 | Dekker et al. | 252/8.8 |
| 4,661,269 | 4/1987 | Trinh et al. | 252/8.8 |

*Primary Examiner*—A. Lionel Clingman

*Attorney, Agent, or Firm*—Robert B. Aylor; Richard C. Witte

[57] ABSTRACT

Liquid fabric softening compositions for use in a rinse bath after washing fabrics with a detergent. The softening compositions have a pH of from about 2 to about 6 and contain certain specific yellow/blue colorants at levels which provide a yellow color in the composition and when said compositions are diluted in the rinse water of a typical laundry process, they have a pH of more than about 7.5 and a desirable blue color.

20 Claims, No Drawings

ACIDIC LIQUID FABRIC SOFTENER WITH YELLOW COLOR THAT CHANGES TO BLUE UPON DILUTION

TECHNICAL FIELD

This invention relates to compositions and methods for softening fabrics during the rinse cycle of home laundering operations. This is a widely used practice to impart to laundered fabrics a texture or hand that is smooth, pliable and fluffy to the touch (i.e., soft).

Liquid fabric softening compositions have long been known in the art and are widely utilized by consumers during the rinse cycles of automatic laundry operations. The term "fabric softening" as used herein and as known in the art refers to a process whereby a desirably soft hand and fluffy appearance are imparted to fabrics.

BACKGROUND ART

Compositions containing cationic nitrogenous compounds in the form of quaternary ammonium salts and substituted imidazolinium salts having two long chain acyclic aliphatic hydrocarbon groups are commonly used to provide fabric softening benefits when used in laundry rinse operations (See, for example, U.S. Pat. Nos. 3,644,203, Lamberti et al., issued Feb. 22, 1972; and 4,426,299, Verbruggen, issued Jan. 17, 1984, said patents being incorporated herein by reference; also "Cationic Surface Active Agents as Fabric Softeners," R. R. Egan, Journal of the American Oil Chemists' Society, January 1978, pages 118–121; and "How to Choose Cationics for Fabric Softeners," J. A. Ackerman, Journal of the American Oil Chemists' Society, June 1983, pages 1166–1169).

Quaternary ammonium salts having only one long chain acyclic aliphatic hydrocarbon group (such as monostearyltrimethyl ammonium chloride) are less commonly used because for the same chain length, compounds with two long alkyl chains were found to provide better softening performance than those having one long alkyl chain. (See, for example, "Cationic Fabric Softeners," W. P. Evans, Industry and Chemistry, July 1969, pages 893–903). U.S. Pat. No. 4,464,272, Parslow et al., issued Aug. 7, 1984, incorporated herein by reference, also teaches that monoalkyl quaternary ammonium compounds are less effective softeners.

Another class of nitrogenous materials that are sometimes used in fabric softening compositions are the non-quaternary amide-amines. A commonly cited material is the reaction product of higher fatty acids with hydroxy alkyl alkylene diamines. An example of these materials is the reaction product of higher fatty acids and hydroxyethylethylenediamine (See "Condensation Products from β-Hydroxyethylethylenediamine and Fatty Acids or Their Alkyl Esters and Their Application as Textile Softeners in Washing Agents," H. W. Eckert, Fette-Seifen-Anstrichmittel, September 1972, pages 527–533). These materials are usually cited generically along with other cationic quaternary ammonium salts and imidazolinium salts as softening actives in fabric softening compositions. (See U.S. Pat. Nos. 4,460,485, Rapisarda et al., issued July 17, 1984; 4,421,792, Rudy et al., issued Dec. 20, 1983; 4,327,133, Rudy et al., issued Apr. 27, 1982, all of said patents being incorporated herein by reference). U.S. Pat. No. 3 775,316, Berg et al., issued Nov. 27, 1973, incorporated herein by reference, discloses a softening finishing composition for washed laundry containing (a) the condensation product of hydroxyalkyl alkylpolyamine and fatty acids and (b) a quaternary ammonium compound mixture of (i) from 0% to 100% of quaternary ammonium salts having two long chain alkyl groups and (ii) from 100% to 0% of a germicidal quaternary ammonium compound of the formula $[R_5R_6R_7R_8N]+ A^-$ wherein $R_5$ is a long chain alkyl group, R6 is a is along chain alkyl group, $R_6$ is a member selected from the group consisting of arylalkyl group and $C_3$–$C_{18}$ alkenyl and alkadienyl containing one or two C=C double bonds, $R_7$ and $R_8$ are $C_1$–$C_7$ alkyl groups, and A is an anion. U.S. Pat. No. 3,904,533, Neiditch et al., issued Sept. 9, 1975, incorporated herein by reference, teaches a fabric conditioning formulation containing a fabric softening compound and a low temperature stabilizing agent which is a quaternary ammonium salt containing one to three short chain $C_{10}$–$C_{14}$ alkyl groups; the fabric softening compound is selected from a group consisting of quaternary ammonium salts containing two or more long chain alkyl groups, the reaction product of fatty acids and hydroxyalkyl alkylene diamine, and other cationic materials.

SUMMARY OF THE INVENTION

The present invention relates to acidic fabric softening compositions in liquid form for use in home laundry operations. The present invention is based on the discovery that only a very few colors impart a desirable yellow color to the fabric softening composition dyes and then change to blue when added to the rinse water.

According to the present invention, a fabric softening composition is provided in the form of an acidic aqueous dispersion comprising from about 3% to about 35% by weight of fabric softener, and from about 1 ppm to about 1,000 ppm, preferably from about 5 ppm to about 200 ppm of a color system comprising a yellow/blue colorant selected from the group consisting of: nitrazine yellow; bromothymol blue; and mixtures thereof. The pH of the composition is typically less than about 6, and more typically from about 2 to about 5, preferably from about 2.5 to about 4.

DETAILED DESCRIPTION OF THE INVENTION

The amount of fabric softening agent in the compositions of this invention is typically from about 3% to about 35%, preferably from about 4% to about 27%, by weight of the composition. The lower limits are amounts needed to contribute effective fabric softening performance when added to laundry rinse baths in the manner which is customary in home laundry practice. The higher limits are suitable for concentrated products which provide the consumer with more economical usage due to a reduction of packaging and distributing costs.

Some preferred compositions are disclosed in U.S. Pat. No. 4 661,269, issued Apr. 28, 1987, in the names of Toan Trinh, Errol H. Wahl, Donald M. Swartley and Ronald L. Hemingway, said patent being incorporated herein by reference.

The Composition

The aqueous acidic fabric softening composition having a pH of less than about 6 comprises the following components:

I. from about 3% to about 35%, preferably from about 4% to about 27%, by weight of the total composition of a fabric softener, and from about 1 ppm to about 1,000 ppm, preferably from about 5 ppm to about 200 ppm of a yellow color system comprising a visible amount of a yellow colorant selected from the group consisting of: nitrazine yellow; bromothymol blue; and mixtures thereof. These colorants provide a desirable yellow in the composition, but upon dilution in the rinse water form a blue plume. Thus, the composition upon dilution with more than about 100 parts of water per part of said composition, preferably with more than about 250 parts of water, has a pH of more than about 7.5.

One suitable fabric softener is a mixture comprising:

(a) from about 10% to about 92% of the reaction product of higher fatty acids with a polyamine selected from the group consisting of hydroxyalkylalkylenediamines diamines and dialkylenetriamines and mixtures thereof;

(b) from about 8% to about 90% of cationic nitrogenous salts containing only one long chain acyclic aliphatic $C_{15}$–$C_{22}$ hydrocarbon group; and optionally, (c) from 0% to about 80% of cationic nitrogenous salts having two or more long chain acyclic aliphatic $C_{15}$–$C_{22}$ hydrocarbon groups or one said group and an arylalkyl group;

said (a), (b) and (c) percentages being by weight of Component I; and

II. the balance of the composition comprising a liquid carrier selected from the group consisting of water and mixtures of the water and $C_1$–$C_4$ alcohols, preferably monohydric alcohols, said composition having a pH of from about 2 to about 5, more preferably from about 2.5 to about 4.

As used herein, Component I comprises the mixture of fabric softening actives.

Following are the general descriptions of the essentials and optionals of the present compositions including a specific example. The example is provided herein for purposes of illustration only and is not intended to limit the claims, unless otherwise specified.

The Colorants

The colorants that are useful for creating a desired yellow color which changes to blue upon dilution are selected from the group consisting of: nitrazine yellow; bromothymol blue; and mixtures thereof, e.g., in ratios of from about 100:1 to about 1:100, preferably from about 10:1 to about 1:10, more preferably from about 4:1 to about 1:4. The structures for these colorants can be found in Aldrich's "Catalog Handbook of Fine Chemicals," (1984–1985), incorporated herein by reference. The chemical name for bromothymol blue is 3′,3″-dibromothymolsulfonephthalein. The pH range for the colorants is about 6.0–7.6.

Most yellow to blue colorants are anionic and interact with the cationic fabric softeners that are preferred herein. It is therefore difficult, if not impossible, to predict from data on the performance of these colorants in solution what will happen in a fabric softener composition.

The level of colorant in the product is typically between about 1 ppm and about 1,000 ppm, preferably between about 5 ppm and about 200 ppm, most preferably between about 10 ppm and about 100 ppm.

The listed colorants meet all of the requirements of these products. They provide a desirable yellow color for such composition that is aesthetically compatible with, e.g., consumer desired lemon, sunshine and/or outdoor scents that connote freshness and cleanliness. However, blue is traditionally associated with whiteness/brightening and yellow is asociated with dingy or dirty clothes. The colorants of this invention which provide a yellow color in the highly acidic composition and which become blue upon dilution are referred to hereinafter as "yellow/blue" colorants.

Most yellow/blue colorants are unsuitable for one or more reasons.

It is understood that equivalent colorants that correspond chemically to the above colorants, are also included when the specific yellow/blue colorants are mentioned.

The yellow/blue colorants of this invention provide an unobvious whitening and/or bluing benefit as compared with a similar composition containing a conventional yellow dye, especially when used on unbrightened terry cloths with a less desirable detergent that does not contain an optical brightener. Under these conditions, the whiteness improvement is almost doubled by the compositions of this invention as compared to a fabric softener composition containing a normal yellow dye, over 10 laundry cycles. (Whiteness is measured using a Hunter Colorimeter.)

The Fabric Softeners

Fabric softeners that can be used herein are disclosed in U.S. Pat. Nos. 3,861,870, Edwards and Diehl; 4,308,151, Cambre; 3,886,075, Bernardino; 4,233,164, Davis; 4,401,578, Verbruggen; 3,974,076, Wiersema and Rieke; and 4,237,016, Rudkin, Clint, and Young, all of said patents being incorporated herein by reference.

A preferred fabric softener of the invention comprises the following:

Component I(a)

A preferred softening agent (active) of the present invention is the reaction products of higher fatty acids with a polyamine selected from the group consisting of hydroxyalkylalkylenediamines and dialkylenetriamines and mixtures thereof. These reaction products are mixtures of several compounds in view of the multifunctional structure of the polyamines (see, for example, the publication by H. W. Eckert in Fette-Seifen-Anstrichmittel, cited above).

The preferred Component I(a) is a nitrogenous compound selected from the group consisting of the reaction product mixtures or some selected components of the mixtures. More specifically, preferred Components I(a) are compounds selected from the group consisting of:

(i) reaction products of higher fatty acids with hydroxyalkylalkylenediamines in molecular ratios of about 2:1, said reaction products containing compounds of the formula:

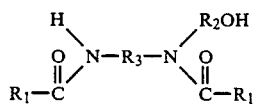

wherein $R_1$ is an acyclic aliphatic $C_{15}$–$C_{21}$ hydrocarbon group and $R_2$ and $R_3$ are divalent $C_1$–$C_3$ alkylene groups;

(ii) substituted imidazoline compounds having the formula:

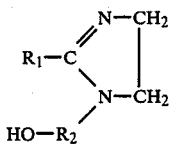

wherein $R_1$ and $R_2$ are defined as above;

(iii) substituted imidazoline compounds having the formula:

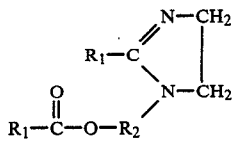

wherein $R_1$ and $R_2$ are defined as above;

(iv) the reaction product of higher fatty acids with dialkylenetriamines in a molecular ratio of about 2:1, said reaction product containing a composition having a compound of the formula:

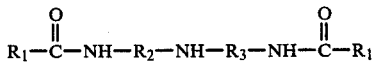

wherein $R_1$, $R_2$ and $R_3$ are defined as above; and (v) substituted imidazoline compounds having the formula:

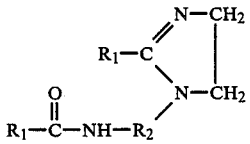

wherein $R_1$ and $R_2$ are defined as above; and mixtures thereof.

Component I(a)(i) is commercially available as Mazamide® 6, sold by Mazer Chemicals, or Ceranine® HC, sold by Sandoz Colors & Chemicals; here the higher fatty acids are hydrogenated tallow fatty acids and the hydroxyalkylalkylenediamine is N-2-hydroxyethylethylenediamine, and $R_1$ is an aliphatic $C_{15}$–$C_{17}$ hydrocarbon group, and $R_2$ and $R_3$ are divalent ethylene groups.

An example of Component I(a)(ii) is stearic hydroxyethyl imidazoline wherein $R_1$ is an aliphatic $C_{17}$ hydrocarbon group, $R_2$ is a divalent ethylene group; this chemical is sold under the trade names of Alkazine® ST by Alkaril Chemicals, Inc., or Schercozoline® S by Scher Chemicals, Inc.

An example of Component I(a)(iv) is N,N''-ditallowalkoyldiethylenetriamine where $R_1$ is an aliphatic $C_{15}$–$C_{17}$ hydrocarbon group and $R_2$ and $R_3$ are divalent ethylene groups.

An example of Component I(a)(v) is 1-tallowamidoethyl-2-tallowimidazoline wherein $R_1$ is an aliphatic $C_{15}$–$C_{17}$ hydrocarbon group and $R_2$ is a divalent ethylene group.

The Component I(a)(v) can also be first dispersed in a Bronstedt acid dispersing aid having a pKa value of not greater than 6; provided that the pH of the final composition is not greater than about 4. Some preferred dispersing aids are formic acid, phosphoric acid, or methylsulfonic acid.

Both N,N''-ditallowalkoyldiethylenetriamine and 1-tallowethylamido-2-tallowimidazoline are reaction products of tallow fatty acids and diethylenetriamine, and are precursors of the cationic fabric softening agent methyl-1-tallowamidoethyl-2-tallowimidazolinium methylsulfate (see "Cationic Surface Active Agents as Fabric Softeners," R. R. Egan, Journal of the American Oil Chemicals' Society, January 1978, pages 118–121). N,N''-ditallowlkoyldiethylenetriamine and 1-tallowamidoethyl-2-tallowimidazoline can be obtained from Sherex Chemical Company as experimental chemicals. Methyl-1-tallowamidoethyl-2-tallowimidazolinium methylsulfate is sold by Sherex Chemical Company under the trade name Varisoft® 475.

Component I(b)

Preferred Components I(b) are cationic nitrogenous salts containing one long chain acyclic aliphatic $C_{15}$–$C_{22}$ hydrocarbon group selected from the group consisting of:

(i) acyclic quaternary ammonium salts having the formula:

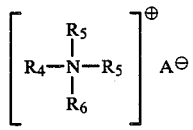

wherein $R_4$ is an acyclic aliphatic $C_{15}$–$C_{22}$ hydrocarbon group, $R_5$ and $R_6$ are $C_1$–$C_4$ saturated alkyl or hydroxy alkyl groups, and $A^\theta$ is an anion;

(ii) substituted imidazolinium salts having the formula:

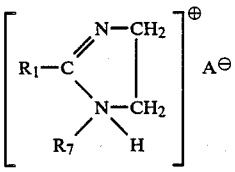

wherein $R_1$ is an acyclic aliphatic $C_{15}$–$C_{21}$ hydrocarbon group, $R_7$ is a hydrogen or a $C_1$–$C_4$ saturated alkyl or hydroxyalkyl group, and $A^\theta$ is an anion;

(iii) substituted imidazolinium salts having the formula:

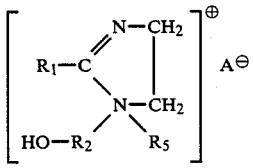

wherein $R_2$ is a divalent $C_1$–$C_3$ alkylene group and $R_1$, $R_5$ and $A^\theta$ are as defined above;

(iv) alkylpyridinium salts having the formula:

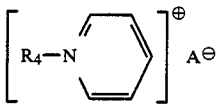

wherein $R_4$ is an acyclic aliphatic $C_{16}$–$C_{22}$ hydrocarbon group and $A^{\theta}$ is an anion; and (v) alkanamide alkylene pyridinium salts having the formula:

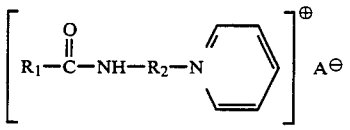

wherein $R_1$ is an acyclic aliphatic $C_{15}$–$C_{21}$ hydrocarbon group, $R_2$ is a divalent $C_1$–$C_3$ alkylene group, and $A^{\theta}$ is an ion group; and mixtures thereof.

Examples of Component I(b)(i) are the monoalkyltrimethylammonium salts such as monotallowtrimethylammonium chloride, mono(hydrogenated tallow)-trimethylammonium chloride, palmityltrimethylammonium chloride and soyatrimethylammonium chloride, sold by Sherex Chemical Company under the trade names Adogen® 471, Adogen 441, Adogen 444, and Adogen 415, respectively. In these salts, $R_4$ is an acyclic aliphatic $C_{16}$–$C_{18}$ hydrocarbon group, and $R_5$ and $R_6$ are methyl groups. Mono(hydrogenated tallow)-trimethylammonium chloride and monotallowtrimethylammonium chloride are preferred. Other examples of Component I(b)(i) are behenyltrimethylammonium chloride wherein $R_4$ is a $C_{22}$ hydrocarbon group and sold under the trade name Kemamine® Q2803-C by Humko Chemical Division of Witco Chemical Corporation; soyadimethylethylammonium - ethosulfate wherein $R_4$ is a $C_{16}$–$C_{18}$ hydrocarbon group, $R_5$ is a methyl group, $R_6$ is an ethyl group, and A is an ethylsulfate anion, sold under the trade name Jordaquat® 1033 by Jordan Chemical Company; and methyl-bis(2-hydroxyethyl)octadecylammonium chloride wherein $R_4$ is a $C_{18}$ hydrocarbon group, $R_5$ is a 2-hydroxyethyl group and $R_6$ is a methyl group and available under the trade name Ethoquad® 18/12 from Armak Company.

An example of Component I(b)(iii) is 1-ethyl-1-(2-hydroxy- ethyl)-2-isoheptadecylimidazolinium ethylsulfate wherein $R_1$ is a $C_{17}$ hydrocarbon group, $R_2$ is an ethylene group, $R_5$ is an ethyl group, and A is an ethylsulfate anion. It is available from Mona Industries, Inc., under the trade name Monaquat® ISIES.

A preferred composition contains Component I(a) at a level of from about 50% to about 90% by weight of Component I and Component I(b) at a level of from about 10% to about 50% by weight of Component I.

Cationic Nitrogenous Salts I(c)

Preferred cationic nitrogenous salts having two or more long chain acyclic aliphatic $C_{15}$–$C_{22}$ hydrocarbon groups, or one said group and an arylalkyl group, which salts can be used either alone or as part of a mixture are selected from the group consisting of:

(i) acyclic quaternary ammonium salts having the formula:

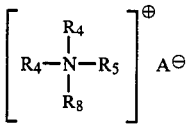

wherein $R_4$ is an acyclic aliphatic $C_{15}$–$C_{22}$ hydrocarbon group, $R_5$ is a $C_1$–$C_4$ saturated alkyl or hydroxyalkyl group, $R_8$ is selected from the group consisting of $R_4$ and $R_5$ groups, and $A^{\theta}$ is an anion defined as above;

(ii) diamido quaternary ammonium salts having the formula:

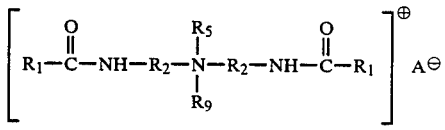

wherein $R_1$ is an acyclic aliphatic $C_{15}$–$C_{21}$ hydrocarbon group, $R_2$ is a divalent alkylene group having 1 to 3 carbon atoms, $R_5$ and $R_9$ are $C_1$–$C_4$ saturated alkyl or hydroxyalkyl groups, and $A^{\theta}$ is an anion;

(iii ) diamino alkoxylated quaternary ammonium salts having the formula:

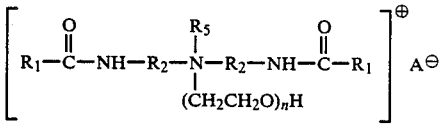

wherein n is equal to 1 to about 5, and $R_1$, $R_2$, $R_5$ and $A^{\theta}$ are as defined above;

(iv) quaternary ammonium compounds having the formula:

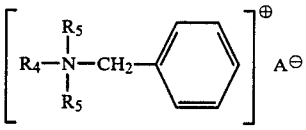

wherein $R_4$ is an acyclic aliphatic $C_{15}$–$C_{22}$ hydrocarbon group, $R_5$ is a $C_1$–$C_4$ saturated alkyl or hydroxyalkyl group, $A^{\theta}$ is an anion;

(v) substituted imidazolinium salts having the formula:

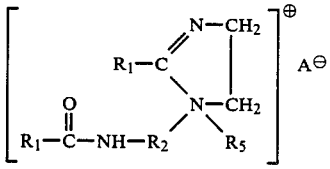

wherein $R_1$ is an acyclic aliphatic $C_{15}$–$C_{21}$ hydrocarbon group, $R_2$ is a divalent alkylene group having 1 to 3 carbon atoms, and $R_5$ and $A^{\theta}$ are as defined above; and (vi) substituted imidazolinium salts having the formula:

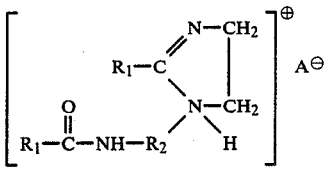

wherein $R_1$, $R_2$ and $A^{\theta}$ are as defined above; and mixtures thereof.

Examples of Component I(c)(i) are the well-known dialkyldimethylammonium salts such as ditallowdimethylammonium chloride, ditallowdimethylammonium methylsulfate, di(hydrogenated tallow)dimethylammonium chloride, distearyldimethylammonium chloride, dibehenyldimethylammonium chloride. Di(hydrogenated tallow)dimethylammonium chloride and ditallowdimethylammonium chloride are preferred. Examples of commercially available dialkyldimethylammonium salts usable in the present invention are di(hydrogenated tallow)dimethylammonium chloride (trade name Adogen 442), ditallowdimethylammonium chloride (trade name Adogen 470), distearyldimethylammonium chloride (trade name Arosurf® TA-100), all available from Sherex Chemical Company. Dibehenyldimethylammonium chloride wherein $R_4$ is an acyclic aliphatic $C_{22}$ hydrocarbon group is sold under the trade name Kemamine Q-2802C by Humko Chemical Division of Witco Chemical Corporation.

Examples of Component I(c)(ii) are methylbis(tallowamidoethyl)(2-hydroxyethyl)ammonium methylsulfate and methylbis(hydrogenated tallowamidoethyl)(2-hydroxyethyl)ammonium methylsulfate wherein $R_1$ is an acyclic aliphatic $C_{15}$–$C_{17}$ hydrocarbon group, $R_2$ is an ethylene group, $R_5$ is a methyl group, $R_9$ is a hydroxyalkyl group and A is a methylsulfate anion; these materials are available from Sherex Chemical Company under the trade names Varisoft 222 and Varisoft 110, respectively.

An example of Component I(c)(iv) is dimethylstearylbenzylammonium chloride wherein $R_4$ is an acyclic aliphatic $C_{18}$ hydrocarbon group, $R_5$ is a methyl group and A is a chloride anion, and is sold under the trade names Varisoft SDC by Sherex Chemical Company and Ammonyx® 490 by Onyx Chemical Company.

Examples of Component I(c)(v) are 1-methyl-1-tallowamidoethyl-2-tallowimidazolinium methylsulfate and 1-methyl-1-(hydrogenated tallowamidoethyl)-2-(hydrogenated tallow)imidazolinium methylsulfate wherein $R_1$ is an acyclic aliphatic $C_{15}$–$C_{17}$ hydrocarbon group, $R_2$ is an ethylene group, $R_5$ is a methyl group and A is a chloride anion; they are sold under the trade names Varisoft 475 and Varisoft 445, respectively, by Sherex Chemical Company.

A preferred composition contains Component I(c) at a level of from about 10% to about 80% by weight of said Component I. A more preferred composition also contains Component I(c) which is selected from the group consisting of: (i) di(hydrogenated tallow)dimethylammonium chloride and (v) methyl-1-tallowamidoethyl2-tallowimidazolinium methylsulfate; and mixtures thereof. A preferred combination of ranges for Component I(a) is from about 10% to about 80% and for Component I(b) from about 8% to about 40% by weight of Component I.

Where Component I(c) is present, Component I is preferably present at from about 4% to about 27% by weight of the total composition. More specifically, this composition is more preferred wherein Component I(a) is the reaction product of about 2 moles of hydrogenated tallow fatty acids with about 1 mole of N-2-hydroxyethylethylenediamine and is present at a level of from about 10% to about 70% by weight of Component I; and wherein Component I(b) is mono(hydrogenated tallow)trimethylammonium chloride present at a level of from about 8% to about 20% by weight of Component I; and wherein Component I(c) is selected from the group consisting of di(hydrogenated tallow)dimethylammonium chloride, ditallowdimethylammonium chloride and methyl-1-tallowamidoethyl-2-tallowimidazolinium methylsulfate, and mixtures thereof; said Component I(c) is present at a level of from about 20% to about 75% by weight of Component I; and wherein the weight ratio of said di(hydrogenated tallow)dimethylammonium chloride to said methyl-1-tallowamidoethyl-2-tallowimidazolinium methylsulfate is from about 2:1 to about 6:1.

The above individual components can also be used individually, especially those of I(c).

Anion A

In the cationic nitrogenous salts herein, the anion $A^{\ominus}$ provides electrical neutrality. Most often, the anion used to provide electrical neutrality in these salts is a halide, such as fluoride, chloride, bromide, or iodide. However, other anions can be used, such as methylsulfate, ethylsulfate, hydroxide, acetate, formate, sulfate, carbonate, and the like. Chloride and methylsulfate are preferred herein as anion A.

Liquid Carrier

The liquid carrier is typically selected from the group consisting of water and mixtures of the water and short chain $C_1$–$C_4$ monohydric and/or polyhydric alcohols. Water can be used distilled, deionized, or tap water. Mixtures of water and up to about 15% of a short chain alcohol such as ethanol, propanol, isopropanol or butanol, and mixtures thereof, are also useful as the carrier liquid.

Optional Ingredients

Adjuvants can be added to the compositions herein for their known purposes. Such adjuvants include, but are not limited to, viscosity control agents, perfumes, emulsifiers, preservatives, antioxidants, bacteriocides, fungicides, brighteners, opacifiers, freeze-thaw control agents, shrinkage control agents, and agents to provide ease of ironing. These adjuvants, if used, are added at their usual levels, generally each of up to about 5% by weight of the composition.

Viscosity control agents can be organic or inorganic in nature. Examples of organic viscosity modifiers are fatty acids and esters, fatty alcohols, and water-miscible solvents such as short chain alcohols. Examples of inorganic viscosity control agents are water-soluble ionizable salts. A wide variety of ionizable salts can be used. Examples of suitable salts are the halides of the group IA and IIA metals of the Periodic Table of the Elements, e.g., calcium chloride, magnesium chloride, sodium chloride, potassium bromide, and lithium chloride. Calcium chloride is preferred. The ionizable salts are particularly useful during the process of mixing the ingredients to make the compositions herein, and later to obtain the desired viscosity. The amount of ionizable salts used depends on the amount of active ingredients used in the compositions and can be adjusted according to the desires of the formulator. Typical levels of salts used to control the composition viscosity are from about 20 to about 6,000 parts per million (ppm), preferably from about 20 to about 4,000 ppm by weight of the composition.

Examples of bacteriocides used in the compositions of this invention are glutaraldehyde, formaldehyde, 2-bromo-2-nitropropane- 1,3-diol sold by Inolex Chemicals under the trade name Bronopol ®, and a mixture of 5-chloro-2-methyl-4-isothiazolin-3-one and 2-methyl-4-isothiazoline-3-one sold by Rohm and Haas Company under the trade name Kathon ® CG/ICP. Typical levels of bacteriocides used in the present compositions are from about 1 to about 1,000 ppm by weight of the composition.

Examples of antioxidants that can be added to the compositions of this invention are propyl gallate, availale from Eastman Chemical Products, Inc., under the trade names Tenox ® PG and Tenox S-1, and butylated hydroxy toluene, available from UOP Process Division under the trade name Sustane ® BHT.

The present compositions may contain silicones to provide additional benefits such as ease of ironing and improved fabric feel. The preferred silicones are polydimethylsiloxanes of viscosity of from about 100 centistokes (cs) to about 100,000 cs, preferably from about 200 cs to about 60,000 cs. These silicones can be used as is, or can be conveniently added to the softener compositions in a preemulsified form which is obtainable directly from the suppliers. Examples of these preemulsified silicones are 60% emulsion of polydimethylsiloxane (350 cs) sold by Dow Corning Corporation under the trade name DOW CORNING ® 1157 Fluid and 50% emulsion of polydimethylsiloxane (10,000 cs) sold by General Electric Company under the trade name General Electric ® SM 2140 Silicones. The optional silicone component can be used in an amount of from about 0.1% to about 6% by weight of the composition.

Soil release agents, usually polymers, are desirable additives at levels of from about 0.1% to about 5%. Suitable soil release agents are disclosed in U.S. Pat. Nos. 4,702,857, Gosselink, issued Oct. 27, 1987; 4,711,730, Gosselink and Diehl, issued Dec. 8, 1987; 4,713,194, Gosselink issued Dec. 15, 1987; and mixtures thereof, said patents being incorporated herein by reference. Other soil release polymers are disclosed in U.S. Pat. No. 4,749,596, Evans, Huntington, Stewart, Wolf, and Zimmerer, issued June 7, 1988, said patent being incorporated herein by reference.

Other minor components include short chain alcohols such as ethanol and isopropanol, which are present in the commercially available quaternary ammonium compounds used in the preparation of the present compositions, ethylene glycol, propylene glycol, etc. The short chain alcohols are normally present at from about 1% to about 10% by weight of the composition.

A preferred composition contains from about 0.2% to about 2% of perfume, from 0% to about 3% of polydimethylsiloxane, from 0% to about 0.4% of calcium chloride, from about 1 ppm to about 1,000 ppm of bacteriocide, from about 10 ppm to about 100 ppm of dye, and from 0% to about 10% of short chain alcohols, by weight of the total composition.

The pH of the compositions of this invention is generally adjusted to be in the range of from about 2 to about 6, preferably from about 2 to about 5, more preferably from about 2.5 to about 4. Adjustment of pH is normally carried out by including a small quantity of free acid in the formulation, Because no strong pH buffers are present, only small amounts of acid are required. Any acidic material can be used; its selection can be made by anyone skilled in the softener arts on the basis of cost, availability, safety, etc. Among the acids that can be used are hydrochloric, sulfuric, phosphoric, citric, maleic, and succinic. The pH upon dilution, however, e.g., at a typical dilution to a concentration of less than about 1 to about 100 parts of water should be more than about 7.5, preferably more than about 8, to permit the desired color change. i.e., the compositions should not be strongly buffered.

The liquid fabric softening compositions of the present invention can be prepared by conventional methods. A convenient and satisfactory method is to prepare the softening active premix at about 72°-77° C., which is then added with stirring to the hot water seat. Temperature-sensitive optional components can be added after the fabric softening composition is cooled to a lower temperature.

The liquid fabric softening compositions of this invention are used by adding to the rinse cycle of conventional home laundry operations. Generally, rinse water has a temperature of from about 5° C. to about 60° C. The concentration of the fabric softener actives of this invention is generally from about 10 ppm to about 200 ppm, preferably from about 25 ppm to about 100 ppm, by weight of the aqueous rinsing bath.

In general, the present invention in its fabric softening method aspect comprises the steps of (1) washing fabrics in a conventional washing machine with a detergent composition; and (2) rinsing the fabrics in a bath which contains the abovedescribed amounts of the fabric softeners; and (3) drying the fabrics. When multiple rinses are used, the fabric softening composition is preferably added to the final rinse. Fabric drying can take place either in an automatic dryer or in the open air.

All percentages, ratios, and parts herein are by weight unless otherwise indicated.

EXAMPLES

| Ingredient | A Wt % | B Wt % | C Wt % |
|---|---|---|---|
| Adogen ® 448E-83HM[1] | 4.50 | 4.50 | 4.50 |
| Varisoft ® 445 | 3.40 | 3.40 | 3.40 |
| Imidazoline[2] | | | |
| Adogen ® 441[3] | 0.57 | 0.57 | 0.57 |
| Polydimethyl Siloxane (55%) | 0.324 | 0.324 | 0.324 |
| Silicone DC 1520 (20%) | 0.015 | 0.015 | 0.015 |
| Perfume | 0.42 | 0.42 | 0.42 |
| Varonic ® T 220 D | 0.10 | 0.10 | 0.10 |
| Kathon ® | 0.034 | 0.034 | 0.034 |
| Tenox ® S-1 | 0.025 | 0.025 | 0.025 |
| Hydrochloric Acid (31.5%) | 0.4–0.9 | 0.4–0.9 | 0.4–0.9 |
| Calcium Chloride 25% Solution | 10 ppm | 10 ppm | 10 ppm |
| D&C Yellow #7 (1% solution in water) | 0.17 | — | |
| Bromothymol Blue (sodium salt, 1% solution in water) | — | 0.17 | — |
| Nitrazine Yellow (1% solution in water) | — | — | 0.17 |

-continued

| Ingredient | A Wt % | B Wt % | C Wt % |
|---|---|---|---|
| Water | Balance | Balance | Balance |

[1]A mixture of ditallowalkyl dimethylammonium chloride and monotallowalkyl trimethylammonium chloride.
[2]Di long chain (tallow) alkyl imidazoline softener.
[3]Monotallowalkyl trimethylammonium chloride.

The base product is made by a process that is similar to processes used for commercial products and the colorants are simply added to the finished product. When these products are used to treat unbrightened terry fabrics that have been washed with a commercial detergent like "ALL®" that has no optical brightener, the change in the Hunter Whiteness Index of 10 laundry cycles as measured on a Hunter Color Difference Meter are +9.7 for Comparative Example A and +15.4 for Example B.

What is claimed is:

1. A fabric softening composition in the form of an acidic aqueous dispersion comprising from about 3% to about 35% by weight of fabric softener and from about 1 ppm to about 1,000 ppm of a colorant system which comprises a colorant selected from the group consisting of nitrazine yellow; bromothymol blue; and mixtures thereof, said composition having a pH of less than about 6, as is, and of more than about 7.5 after dilution with water to a concentration of less than one in 100 parts of water.

2. The composition of claim 1 wherein the fabric softener is present at a level of from about 4% to about 27% and the colorant is present at a level of from about 5 ppm to about 200 ppm.

3. The composition of claim 2 wherein the colorant comprises bromothymol blue.

4. The composition of claim 2 wherein the colorant comprises nitrazine yellow.

5. The composition of claim 2 wherein the colorant comprises a mixture of bromothymol blue and nitrazine yellow.

6. The composition of claim 2 wherein the pH of the composition, as is, is from about 2 to about 5.

7. The composition of claim 6 wherein the pH of the composition is from about 2.5 to about 4.

8. The composition of claim 1 wherein the colorant comprises bromothymol blue.

9. The composition of claim 1 wherein the colorant comprises nitrazine yellow.

10. The composition of claim 1 wherein the colorant comprises a mixture of bromothymol blue and nitrazine yellow.

11. The composition of claim 1 wherein the pH of the composition, as is, is from about 2 to about 5.

12. The composition of claim 1 wherein the pH of the composition is from about 2.5 to about 4.

13. The composition of claim 1 in which said fabric softener comprises:

(a) from about 10% to about 92% of the reaction product of higher fatty acids with a polyamine selected from the group consisting of hydroxyalkylalkylenediamines and dialkylenetriamines and mixtures thereof;

(b) from about 8% to about 90% of cationic nitrogenous salts containing only one long chain acyclic aliphatic $C_{15}$–$C_{22}$ hydrocarbon group; and (c) from 0% to about 80% of cationic nitrogenous salts having two or more long chain acyclic aliphatic $C_{15}$–$C_{22}$ hydrocarbon groups or one said group and an arylalkyl group;

said (a), (b) and (c) percentages being by weight of said fabric softener; and the balance of the composition comprising a liquid carrier selected from the group consisting of water and mixtures of water and $C_1$–$C_4$ alcohols, said composition having a pH of from about 2.0 to about 5.0.

14. The composition of claim 13 wherein the fabric softener is present at a level of from about 4% to about 27% and the colorant is present at a level of from about 5 ppm to about 200 ppm.

15. The composition of claim 14 wherein the colorant comprises bromothymol blue.

16. The composition of claim 14 wherein the colorant comprises nitrazine yellow.

17. The composition of claim 14 wherein the colorant comprises a mixture of bromothymol blue and nitrazine yellow.

18. The composition of claim 13 wherein the pH of the composition, as is, is from about 2 to about 5.

19. The composition of claim 13 wherein the pH of the composition is from about 2.5 to about 4.

20. The process of softening fabrics in the rinse cycle of a laundering process comprising adding the composition of claim 1 in an amount to give a concentration of less than about 1:100 parts of the composition in the rinse water in said rinse cycle, whereby the pH of the rinse water has a pH of greater than about 7.5 and the yellow colorant is changed to blue.

* * * * *